US006109514A

United States Patent [19]

Otis

[11] Patent Number: 6,109,514

[45] Date of Patent: Aug. 29, 2000

[54] MERCHANDISE SHIPPING AND DISPLAY BOX WITH HINGED HEADER PANEL

[75] Inventor: Jon Otis, Long Branch, N.J.

[73] Assignee: E. S. Originals, Inc., New York, N.Y.

[21] Appl. No.: 09/481,668

[22] Filed: Jan. 12, 2000

[51] Int. Cl.[7] ..... B65D 5/42

[52] U.S. Cl. ..... 229/125.19; 206/459.5; 229/164

[58] Field of Search ..... 229/125.19, 164; 206/459.5, 45.29, 737, 767, 768; 40/312

[56] References Cited

U.S. PATENT DOCUMENTS

| | | | |
|---|---|---|---|
| 1,932,429 | 10/1933 | Wellman | 229/125.19 |
| 3,227,266 | 1/1966 | Soma | 229/164 |
| 3,690,450 | 9/1972 | Sheldon | 206/765 |
| 3,912,158 | 10/1975 | Taub | 229/164 |
| 4,206,869 | 6/1980 | Gurevitz | 229/164 |
| 4,756,409 | 7/1988 | Murray | 40/312 |
| 4,964,511 | 10/1990 | Meschi | 229/125.19 |
| 5,377,821 | 1/1995 | Fierek | 206/459.5 |

*Primary Examiner*—Gary E. Elkins
*Attorney, Agent, or Firm*—Kirschstein, et al.

[57] ABSTRACT

A lid mounted on a container maintains a header panel flat against a front wall of the container during shipping of merchandise therein. Upon removal of the lid, the header panel self-deploys to an upwardly- and forwardly-facing display position tilted relative to the front wall to display information relating to the merchandise on display in the container.

10 Claims, 2 Drawing Sheets

MERCHANDISE SHIPPING AND DISPLAY BOX WITH HINGED HEADER PANEL

BACKGROUND OF THE INVENTION

1. Field of the Invention

The present invention generally relates to a box for shipping and displaying retail merchandise and, more particularly, to a header panel integrally hinged to the box and bearing information relating to the merchandise on display in the box.

2. Description of the Related Art

In the sale of retail merchandise, for example, footwear, it is conventional to ship a pair of shoes in a box constructed as a bottom container having four vertical sides perpendicular to a base, and a top lid or cover removably mounted on the container. Information relating to the shoes, for example, style number, size, color, etc., is printed on the outside of one or more of the sides of the container. In order to display the shoes, the lid is often removed and placed underneath the base of the container to expose the shoes therein. This placement of the lid often obscures the printed information on the sides of the container and requires a shopper to remove and replace the lid to render the information more readily visible.

In some retail stores, lid-removed shoe boxes are placed on display shelves to enable the shopper to have readier visibility and access to the shoes therein. Such displays are most effective when the shelves are high off the floor. When such displays are lower, the upper shelves block the view and accessibility of the shoe boxes on the lower shelves. The shopper must bend down for a better look, in which event the shopper often decides to look elsewhere.

SUMMARY OF THE INVENTION

Objects of the Invention

Accordingly, it is a general object of this invention to improve the state of the art of boxes for shipping and displaying retail merchandise.

More particularly, it is an object of the present invention to improve the accessibility and viewability of merchandise on display in their shipping boxes.

Still another object of the present invention is to better display information relating to merchandise on display.

FEATURES OF THE INVENTION

In keeping with the above objects and others which will become apparent hereafter, one feature of the present invention resides, briefly stated, in a box for shipping and displaying merchandise, for example, a pair of shoes, comprising a container having a base wall, a pair of side walls extending perpendicularly to the base wall and spaced apart along a transverse direction, and front and rear walls extending perpendicularly to the base wall and spaced apart along a longitudinal direction perpendicular to the transverse direction. The container is a four-sided, open-topped structure.

The box further has a lid having a top wall section, a pair of side wall sections extending perpendicularly to the top wall section and spaced apart along the transverse direction, and front and rear wall sections extending perpendicularly to the top wall section and spaced apart along the longitudinal direction. The lid is a four-sided open-bottomed structure that is mounted on the container in a shipping position in which the top wall section is parallel to the base wall, the side wall sections at least partially exteriorly overlie the side walls, and the front and rear wall sections at least partially exteriorly overlie the front and rear walls, respectively.

In accordance with this invention, a header panel for displaying information relating to the merchandise is integrally hinged to the container, preferably to the front wall, for pivoting movement between the shipping position in which the header panel is parallel to the front wall, and a display position in which the header panel is tilted relative to the front wall. Upon removal of the lid, the header panel is freed to move to the tilted display position. Preferably, the header panel is hinged along an upper edge of the front panel so that a lower edge of the header panel is tilted forwardly and upwardly relative to the base, thereby granting better overhead viewability to a shopper to read the information on the header panel.

To improve overhead access to the merchandise in the container, the front wall has a shorter height as compared to the rear wall. Also, the height of the side walls decrease in height as the side walls approach the front wall. The low front of the container enables the shopper to more easily see and remove the contents of the container, especially when the container is situated on shelves of low elevation relative to the ground.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
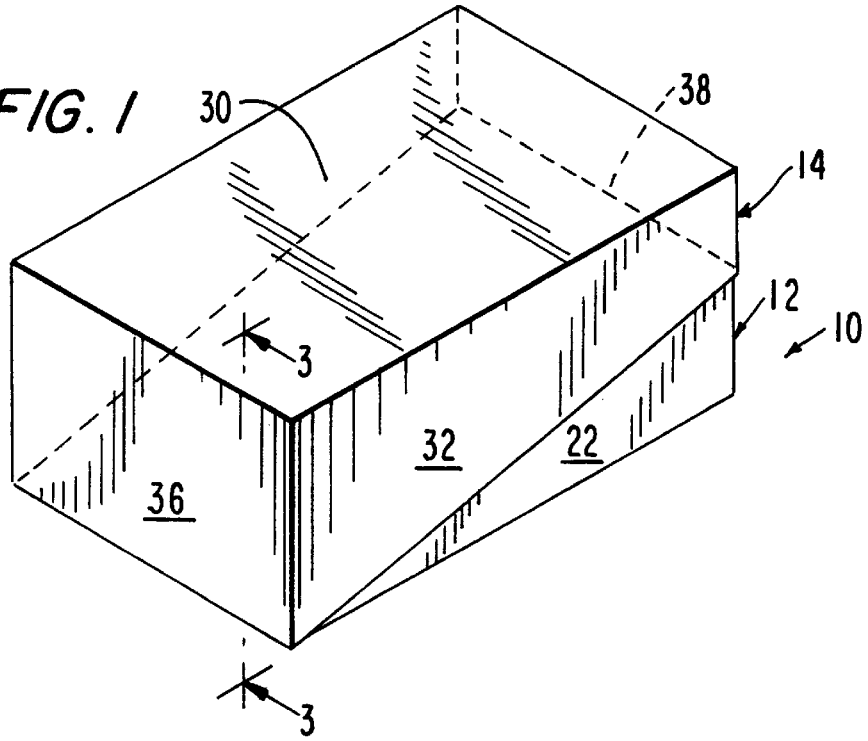
FIG. 1 is a perspective view of a box in a shipping position according to this invention.

Referring now to the drawings, reference numeral 10 generally identifies a box for shipping and displaying merchandise and, as illustrated, a pair of shoes 16. Box 10 includes an open-topped container 12 and an open-bottomed lid 14 that is removably mounted thereon.

Container 12 includes a planar base wall 20, a pair of planar side walls 22, 24 extending perpendicularly to the base wall and spaced apart along a transverse direction widthwise of the container, and a planar front wall 26 and a planar rear wall 28 extending perpendicularly to the base wall and spaced apart along a longitudinal direction lengthwise of the container. The side walls extend between, and are connected to, the front and rear walls to form a four-sided structure to accommodate the shoes 16.

Lid 14 includes a planar top wall section 30, a pair of planar side wall sections, 32, 34 extending perpendicularly to the top wall section and spaced apart along the transverse direction, and a planar front wall section 36 and a planar rear wall section 38 extending perpendicularly to the top wall section and spaced apart along the longitudinal direction.

The side wall sections extend between, and are connected to, the front and rear wall sections to form a four-sided cover.

When the lid 14 is mounted on the container, as shown in FIG. 1, the base wall 20 and the top wall section 30 are parallel to each other; the side wall sections 32, 34 at least partially exteriorly overlap the side walls 22, 24; and the front and rear wall sections 36, 38 at least partially exteriorly overlap the front and rear walls 26, 28, respectively. The lid-mounted container represents a shipping position in which the shoes are transported from a manufacturer to a retail site.

In accordance with one feature of this invention, a header panel 40 is integrally hinged to the container for pivoting movement between the shipping position in which the header panel overlaps and is parallel to the front wall 26, and a display position in which the header panel is tilted relative to the front wall. As described in detail below, the lid and, more specifically, the front wall section 36 captures the header panel 40 between the front wall section and the front wall 26, to thereby hold the header panel up against the front wall in the shipping position. Upon removal of the lid, the header panel 40 is freed to self-deploy to the tilted display position.

Figure 4:
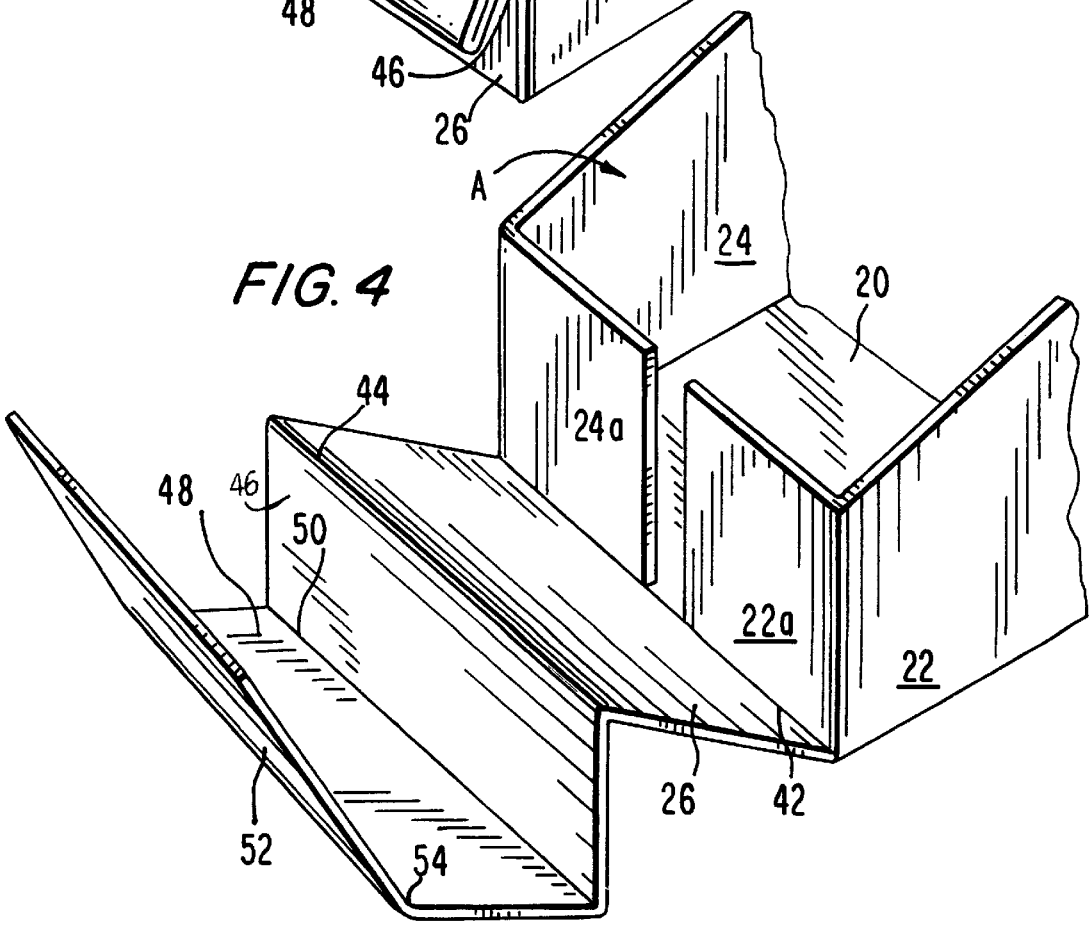
FIG. 4 is a perspective view of the front end region of the box of FIG. 1 during assembly.

More specifically, as shown in FIG. 4, the header panel and the front wall are part of a multi-folded extension of the base wall 20. A first folded rectangular portion of the extension that is immediately adjacent to the base wall 20 constitutes the front wall 26 and has a lower edge 42 and an upper edge 44. A second folded rectangular portion 46 is folded around upper edge 44 in front of the front wall 26. A third folded rectangular portion 48 is folded around a fold line 50 between the rectangular portions 46, 48. A fourth folded rectangular portion or panel 52 is folded around a fold line 54 between the rectangular portions 48, 52. As also shown in FIG. 4, side flaps 22*a*, 24*a* are formed as continuations of the side walls 22, 24 and are folded inwardly to lie in a common plane at the front of the container.

The extension is folded as follows: First, the front wall 26 is folded upwardly around edge 42 and glued to the outer surfaces of the side flaps 22*a*, 24*a*. Next, the outermost portion 52 is swung around in the direction of arrow A until it overlies the inner surfaces of the side flaps 22*a*, 24*a* and is glued thereto. Hence, the front panel assembly includes the front panel 26 and the outermost panel 52, as well as the flaps 22*a*, 24*a* which are sandwiched by the panels 26, 52.

Figure 3:
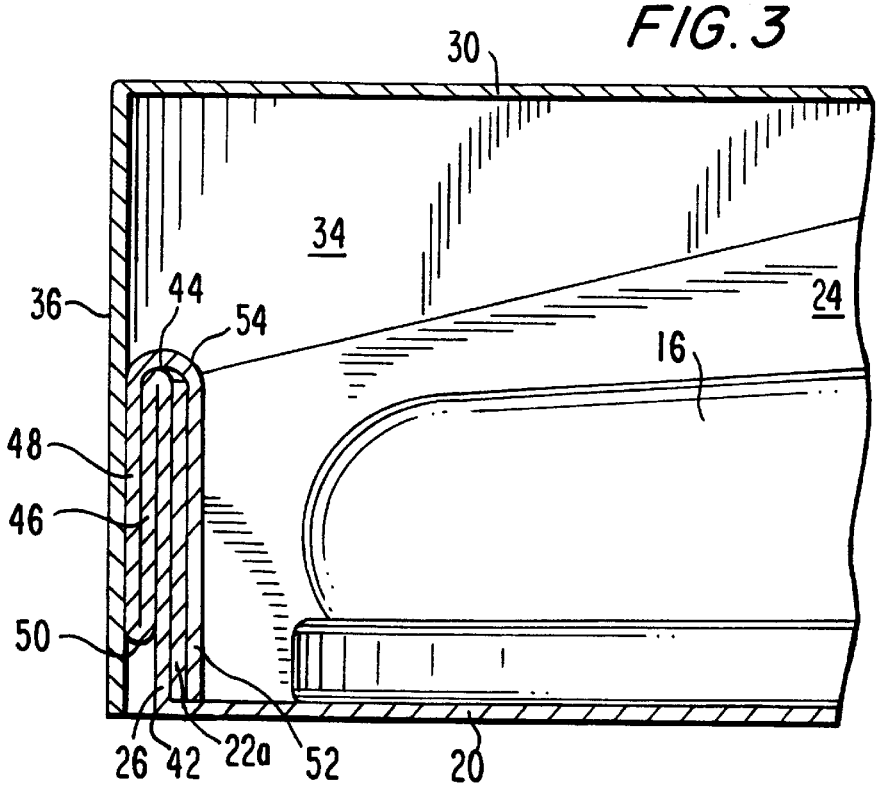
FIG. 3 is an enlarged sectional view taken on line 3–3 of FIG. 1.
Figure 2:
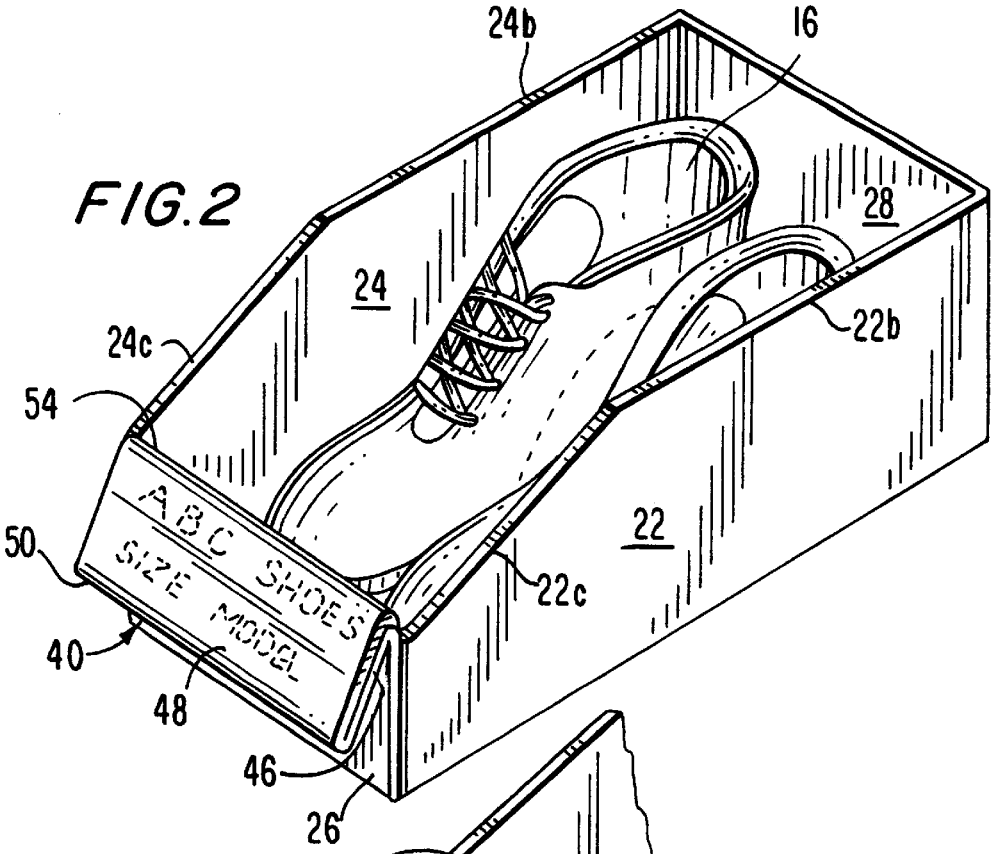
FIG. 2 is a perspective view of the box of FIG. 1 with the lid removed.

The rectangular portions 46, 48 together constitute the header panel 40. As shown in FIG. 2, the header panel is hinged at fold line 54 to an upper edge of the front panel. The fold line 50 at the bottom of the header panel is free to move toward and away from the front panel. As shown in FIG. 3, the header panel 40 is pressed flat against the front panel in the shipping position by the front wall section 36 of the lid. Once the lid is removed, the header panel is freed to move to the display position of FIG. 2 in which the header panel is tilted and faces upwardly and forwardly. Information relating to the merchandise, such as size, model number and name of the manufacturer or brand name, is printed on the outer surface of header panel portion 48 and is readily viewable by a shopper due to its tilted orientation. The movement of the header panel is caused by the natural tendency of the header panel to swing outwardly. The attachment of the outermost panel 52 behind the side flaps 22*a*, 24*a* puts tension on the header panel, and this tension is only released when the confining action of the lid is removed.

FIG. 2 depicts that the height of the front panel 26 is less than the height of the rear panel 28, and that the height of the side panels 22, 24 accommodates this height difference by being tapered in the region of the front of the container. Thus, side panels 22, 24 have upper rear linear edges 22*b*, 24*b* that are parallel to the base wall 20, and upper front linear edges 22*c*, 24*c* that are tapered and decrease in height in a direction toward the front panel. The front of the container is thus not only open at its top, but also at least partially open at its front to provide readier physical access to the merchandise therein.

As shown in FIG. 1, the height of the front panel section 36 of the lid is greater than the height of the rear panel section 38, and the height of the side panel sections 32, 34 accommodates this height difference by being linearly tapered along the longitudinal direction from the front panel section to the rear panel section. The greater height of the front panel section 36 is needed to insure that the header panel is pressed against the front wall 26 in the shipping position.

It will be understood that each of the elements described above, or two or more together, also may find a useful application in other types of constructions differing from the types described above.

While the invention has been illustrated and described as embodied in a merchandise shipping and display box with a hinged header panel, it is not intended to be limited to the details shown, since various modifications and structural changes may be made without departing in any way from the spirit of the present invention. For example, the merchandise need not be a pair of shoes, but can be any retail item.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

I claim:

1. A box for shipping and displaying merchandise, comprising:

a) a container having a base wall, a pair of side walls extending perpendicularly to the base wall and spaced apart along a transverse direction, and front and rear walls extending perpendicularly to the base wall and spaced apart along a longitudinal direction that is perpendicular to the transverse direction;

b) a header panel for displaying information relating to the merchandise, the header panel being integrally hinged to the container for pivoting movement between a shipping position in which the header panel is parallel to the front wall, and a display position in which the header panel is tilted relative to the front wall; and c) a lid mounted on the container to hold the header panel in the shipping position, and removable from the container to enable the header panel to move to the display position.

2. The box according to claim 1, wherein the header panel is hinged to the front wall along a pivot axis extending along the transverse direction.

3. The box according to claim 2, wherein the header panel has a pair of header panel sections folded over one another along a header axis extending along the transverse direction.

4. The box according to claim 2, wherein the front wall has an upper front edge elevated above the base wall, and wherein the pivot axis extends along the upper front edge of the front wall.

5. The box according to claim 1, wherein the header panel has an upper header edge extending along the transverse direction and about which the header panel is pivoted, and wherein the header panel has a lower header edge spaced away from the front panel in the display position.

6. The box according to claim 1, wherein the front wall lies in a vertical plane, and wherein the header panel lies in a header plane generally parallel to the vertical plane in the shipping position, and intersecting the vertical plane in the display position.

7. The box according to claim 1, wherein each of the side walls extends from the rear wall to the front wall along the longitudinal direction, and wherein the front and rear walls have different heights, and wherein the height of the front wall is less than the height of the rear wall, and wherein each of the side walls has a height that decreases as considered along the longitudinal direction from the rear wall to the front wall.

8. The box according to claim 1, wherein the lid has a top wall section parallel to the base wall in the shipping position, a pair of side wall sections extending perpendicularly to the top wall section and spaced apart along the transverse direction, and front and rear wall sections extending perpendicularly to the top wall section and spaced apart along the longitudinal direction; and wherein the side wall sections at least partially exteriorly overlap the side walls in the shipping position; and wherein the rear wall section at least partially exteriorly overlaps the rear wall in the shipping position; and wherein the front leas section at least partially exteriorly overlaps the header panel and the front wall in the shipping position.

9. The box according to claim 8, wherein each of the side wall sections extends from the rear wall section to the front wall section along the longitudinal direction, and wherein the front and rear wall sections have different heights, and wherein the height of the front wall section is greater than the height of the rear wall section, and wherein each of the side walls has a height that increases as considered along the longitudinal direction from the rear wall section to the front wall section.

10. The box according to claim 1, wherein the container and the header panel are constituted of a single piece of heavy-duty paper.

* * * * *